US006423424B1

(12) United States Patent
Haarer

(10) Patent No.: US 6,423,424 B1
(45) Date of Patent: Jul. 23, 2002

(54) METHOD OF PRODUCING AN OPENING CYLINDER

(75) Inventor: Friedrich Haarer, Neubulach (DE)

(73) Assignee: Hollingsworth GmbH, Neubulach (DE)

( * ) Notice: Subject to any disclaimer, the term of this patent is extended or adjusted under 35 U.S.C. 154(b) by 0 days.

(21) Appl. No.: 09/296,854

(22) Filed: Apr. 22, 1999

(30) Foreign Application Priority Data

Apr. 28, 1998 (DE) ..... 198 18 997

(51) Int. Cl.[7] ..... D01G 15/14; D01G 19/00; B23K 101/08

(52) U.S. Cl. ..... 428/592; 492/35; 492/44; 29/895.211; 29/895.31

(58) Field of Search ..... 492/35, 43, 44; 29/895.211, 895.31; 428/594, 592, 586, 600

(56) References Cited

U.S. PATENT DOCUMENTS 425,087 A * 4/1890 Graf ..... 29/895.211
1,016,098 A * 1/1912 Sargent ..... 29/895.211
1,942,304 A * 1/1934 Mylting ..... 492/44
3,831,243 A * 8/1974 Conrad ..... 492/35
4,149,303 A * 4/1979 Appenzeller ..... 492/44
4,192,050 A * 3/1980 Appenzeller ..... 492/35
4,903,385 A * 2/1990 Schmolke ..... 29/895.211
4,983,808 A * 1/1991 Schmolke ..... 219/121.64
5,065,511 A * 11/1991 Graf ..... 29/895.211

OTHER PUBLICATIONS

A.D. Merriman, A Dictionary of Metallurgy, "Weld", 1958 (no month), p. 386.*

* cited by examiner

*Primary Examiner*—John J. Zimmerman
(74) *Attorney, Agent, or Firm*—Townsend and Townsend and Crew LLP

(57) ABSTRACT

The present invention relates to a method of producing an opening cylinder for an open-end spinning machine, comprising the step of applying to the surface of a body of the opening cylinder a spirally extending sawtooth wire. For simplifying such a method and for making it less expensive, the present invention is so conceived that the sawtooth wire is supplied continuously to the body and welded to said body.

31 Claims, 3 Drawing Sheets

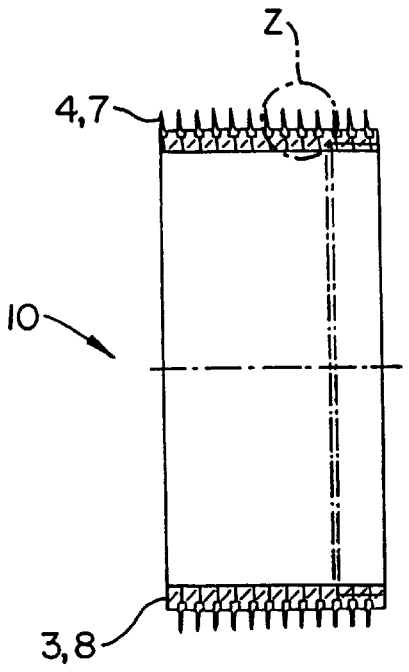
FIG. 2.1
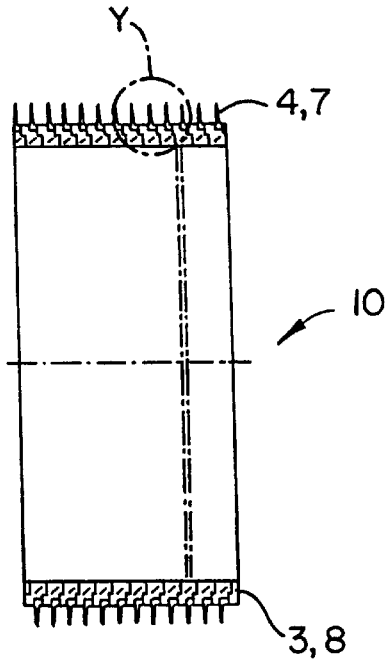
FIG. 3.1
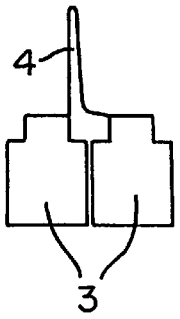
FIG. 2.2
"Z"
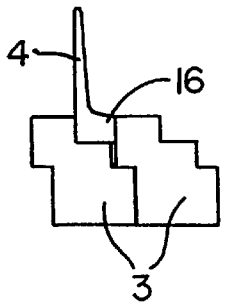
FIG. 3.2
"Y"

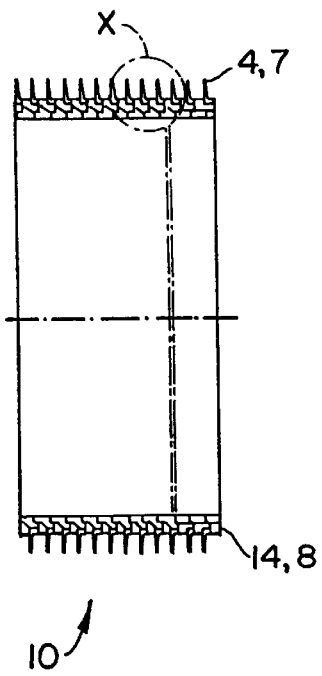
FIG. 4.1
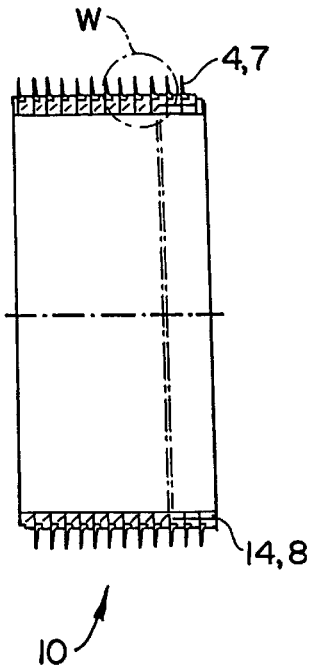
FIG. 5.1
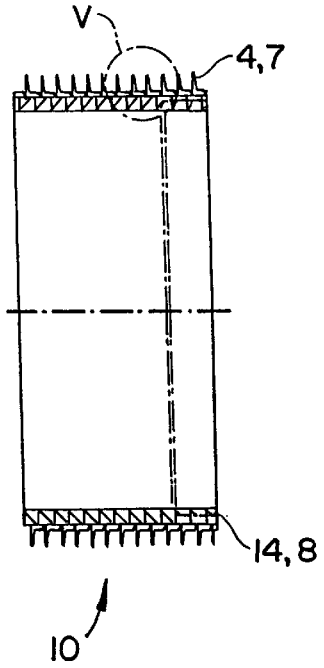
FIG. 6.1
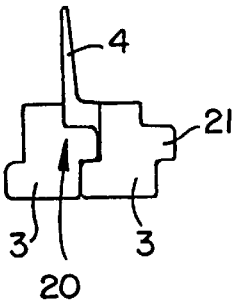
FIG. 4.2
"X"
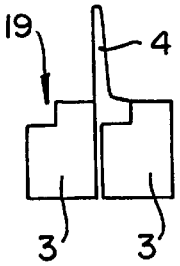
FIG. 5.2
"W"
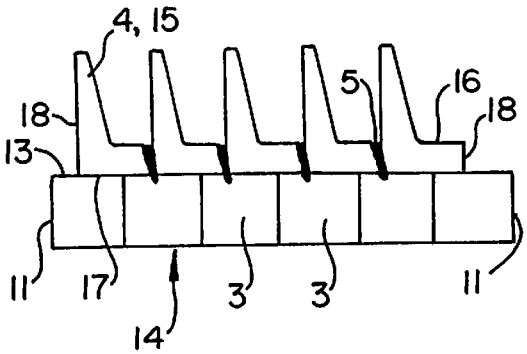
FIG. 6.2
"V"

METHOD OF PRODUCING AN OPENING CYLINDER

BACKGROUND OF THE INVENTION

1. Field of the Invention;

The present invention relates to a method of producing an opening cylinder for an open-end spinning machine, comprising the step of applying to the surface of a body of the opening cylinder a spirally extending sawtooth wire 2. Description of the Prior Art;

For producing opening cylinders, a sawtooth wire is normally forced into threadlike grooves turned into the circumference of the body of the opening cylinder. This is described e.g. in DE-A-2 752 591. By means of opening cylinders produced in this way, the fibres of the fibre entanglement are separated into individual fibres and transported to the fibre guide channel of the open-end spinning machine. The opening cylinders are normally driven at a speed of 5000 to 12000 revolutions per minute. The speed depends on the material to be processed.

The hitherto known production methods prove to be time-consuming and expensive, since the grooves must first be turned into the circumference of the opening cylinder and the sawtooth wire must then be forced into said grooves.

SUMMARY OF THE INVENTION

Hence, it is the object of the present invention to improve a method for producing opening cylinders for an open-end spinning machine in such a way that the opening cylinder can be produced at a more reasonable price and with less expenditure of time.

According to the present invention, this object is achieved by the feature that the sawtooth wire is supplied continuously to the body and welded to said body.

This solution is simple and advantageous insofar as a pre-treatment of the surface of the opening cylinder is not necessary. The sawtooth wire is wound onto the body in a continuous process and is reliably and simply anchored to the opening cylinder by welding.

In this connection, it can be advantageous when the sawtooth wire is is supplied to the rotating body. This will simplify the production process still further. The equipment required for carrying out the method can be realized more easily than in the case of methods where the body is stationary and the sawtooth wire has to be conducted around said body.

According to an advantageous further development of the present invention, the body can be formed by winding a basic wire onto a rotating expansion arbor, whereby also the body can be produced rapidly and easily.

In this connection, it can be advantageous when the spirals which are formed by winding on the basic wire and which abut on one another are welded together during the winding operation. The same production method which is used for applying the sawtooth wire can then also be used for producing the body of the opening cylinder.

In this respect, it may in particular prove to be advantageous when the basic wire and the sawtooth wire are supplied simultaneously. It is then possible to produce the body and to apply the sawtooth wire to said body in one operation. On the basis of this improvement, the production method for a opening cylinder can be simplified substantially.

In this connection, it can be advantageous when the spirals formed by winding on the sawtooth wire are welded to the basic wire. The sawtooth wire can be anchored reliably on the opening cylinder in this way. p It may also prove to be advantageous when the spirals formed by winding on the sawtooth wire abut on one another and are welded together. The strength of finished opening cylinder can be increased still further in this way. The sawtooth wire can be connected to the body by welding and the spirals of the sawtooth wire can be connected to one another by welding in immediately successive production processes.

In order to simplify the production method still further, the welding can be carried out immediately when the basic wire or the sawtooth wire are being supplied. This will save additional time.

In this connection, it can also be advantageous when the welding is carried out continuously. Continuous welds can be produced in this way. On the one hand, the strength of the welds and, consequently, of the opening cylinder as a whole can be improved in this way and, on the other hand, continuous operating procedures, which can be carried out more rapidly, are possible.

In accordance with an alternative embodiment, the welding can also be carried out in the form of discontinuous welding processes, preferably a high-frequency pulsed current arc welding process or a spot welding process.. The manufacturing speed of the opening cylinder can be increased in this way.

In accordance with an advantageous further development of the method, at least one pressure roller can be provided by means of which the supplied sawtooth wire and/or basic wire is/are pressed against the body which has already been formed and/or against the sawtooth wire which has already been applied. This pressure roller guarantees that the spirals of the sawtooth wire and of the basic wire, respectively, abut on one another and that reliable welding can therefore be carried out as desired.

In this connection, it may be advantageous when the axis of rotation of the pressure roller extends at right angles to the axis of rotation of the body and of the expansion arbor, respectively. When the axis extends in this direction, a particularly high pressure can be applied parallel to the surface of the body and to the axis of rotation of the expansion arbor and of the body, respectively.

According to one embodiment of the method, the basic wire can form a body having an essentially smooth surface onto which the sawtooth wire is applied. This will simplify the production of the opening cylinder substantially. Due to the simple geometries, the production costs can be reduced as well.

In the case of one embodiment of the present method comprising the step of applying the sawtooth wire to a prefabricated body, it may prove to be advantageous when the body is essentially cylindrical. Due to the simple geometries, the method can be carried out at a particularly reasonable price.

In order to increase the strength of the sawtooth wire on the body, the body formed by the basic wire can be provided with spiral grooves which accommodate a base section of the sawtooth wire. In addition to the welded joint between the sawtooth wire and the body, a positive engagement between the sawtooth wire and the basic wire can then be realized as well.

In accordance with an advantageous further development of the present method, the finished body with the sawtooth wire can be given its final shape by turning. Very exacting tolerances of the finished opening cylinder can be realized in this way.

Since thermal stresses may occur due to the welding operation, it may prove to be advantageous when the body having the sawtooth wire welded thereon is straightened. Also this permits a realization of very exacting tolerances of the finished opening cylinder.

It may also prove to be advantageous when the welding method used is a precision welding method, preferably laser-beam welding or electron-beam welding.

It can also be of advantage when the basic wire consists of low-carbon steel. A particularly tenacious opening cylinder can be produced in this way.

In addition, it may of advantage when the the sawtooth wire consists of high-carbon steel. This steel is very suitable for heat treatment processes.

In addition or alternatively, the sawtooth wire may also consist of alloy steel or microalloy steel so as to achieve a particularly high strength.

It may also prove to be advantageous when the length of the cylinder body produced corresponds to the length of one or of a plurality of finished opening cylinders. When the cylinder body produced corresponds to the length of an opening cylinder, said opening cylinder can be produced in one operation. When it corresponds to the length of a plurality of opening cylinders, a plurality of opening cylinders can be produced in one operation, the opening cylinder being sub-divided into pieces of suitable length by cutting off.

According to the present invention, an opening cylinder is additionally provided, which comprises a body on the surface of which a spirally extending sawtooth wire is arranged. For solving the task according to the present invention and for achieving the advantages according to the present invention, such an opening cylinder is so conceived that the sawtooth wire is welded to said body.

It may, however, advantageous to form the body of the opening cylinder by at least one spirally wound basic wire.

In this connection, it may prove advantageous when, in the longitudinal direction of the body, the sawtooth wire borders on two neighbouring spirals of the body defined by the basic wire. At least two spirals of the basic wire can then be connected to one another by welding the spirals to the basic wire.

In this connection, it may prove to be advantageous when the spirals of the basic wire connected by the sawtooth wire are neighbouring spirals. The juxtaposed spirals of the basic wire can then always be interconnected via the sawtooth wire. The strength of the opening cylinder can be increased in this way.

In this respect it may be of advantage when the spirals of the body are only indirectly connected to one another due to the fact that they are welded to the spirals of the sawtooth wire. Hence, one operation will suffice to form the body and to weld it to the sawtooth wire.

For increasing the strength, the neighbouring spirals of the sawtooth wire can be welded together.

The strength of the opening cylinder can additionally be increased when two neighbouring spirals of the sawtooth wire are connected to one another as well as to the body due to through-welding. One welding operation will then suffice to realize a firm connection between two neighbouring spirals of the sawtooth wire and of the basic wire bordering thereon.

BRIEF DESCRIPTION OF THE DRAWINGS

FIG. 2.1 shows a cross-section of an opening cylinder produced by the method according to the present invention;

FIG. 2.2 shows the detail Z of FIG. 2.1;

FIG. 3.1 shows a second embodiment of an opening cylinder produced by a method according to the present invention;

FIG. 3.2 shows the detail Y of FIG. 3.1;

FIG. 4.1 shows a third embodiment of an opening cylinder produced by a method according to the present invention;

FIG. 4.2 shows the detail X of FIG. 4.1;

FIG. 5.1 shows a cross-section through a fourth embodiment of an opening cylinder produced by the method according to the present invention;

FIG. 5.2 shows the detail W of FIG. 5.1;

FIG. 6.1 shows a cross-section through a fifth embodiment of an opening cylinder produced by the method according to the present invention; and FIG. 6.2 shows the detail V of FIG. 6.1.

DETAILED DESCRIPTION OF THE PREFERRED EXEMPLARY EMBODIMENTS

Figure 1:
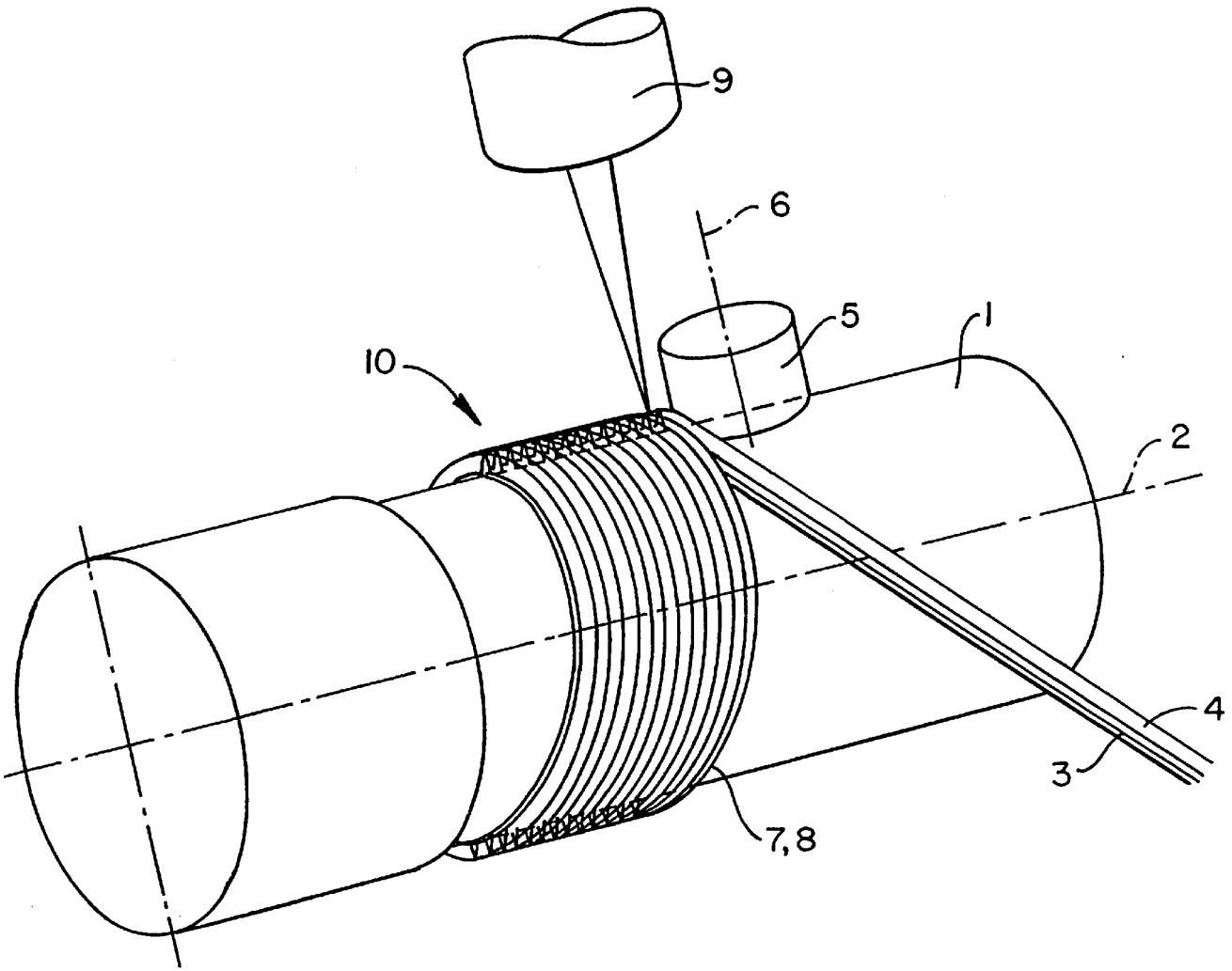
FIG. 1 shows a schematic representation of the method according to the present invention.

In FIG. 1 the mode of operation of a method according to the present invention is shown schematically. An expansion arbor 1 rotates about an axis of rotation 2. The expansion arbor is held and supported in the usual way, which is therefore not shown in detail.

A basic wire 3 and a sawtooth wire 4 are spirally wound onto said expansion arbor simultaneously. The basic wire 3 and the sawtooth wire 4 are guided in parallel for this purpose.

A pressure roller 5 with an axis of rotation 6, which extends at right angles to the axis of rotation 2, presses the supplied basic wire 3 and sawtooth wire 4 against the spirals 7 and 8 which have already been formed from said sawtooth wire 4 and said basic wire 3. Also the pressure roller 5 is supported on a machine frame or the like in the manner known. According to the lead of the winding of the spirals 7 and 8, either the expansion arbor can be displaced axially along its axis of rotation 2 or the pressure roller can be displaced parallel to said axis of rotation 2.

The apparatus is additionally provided with a welding device 9 by means of which the spirals 7 and 8 are welded together. This welding provides a fixed connection between the sawtooth wire 4 and the basic wire 3 as well as between the spirals 7 and 8 of the basic wire 3 and of the sawtooth wire 4. The welding device operates according to the electron-beam welding or laser-beam welding principle. This is a precision welding method by means of which very precise and fine welds can be realized. The welding operation is carried out continuously while the basic wire 3 and the sawtooth wire 4 are wound onto the expansion arbor 1.

After the welding, an opening cylinder 10 for open-end spinning machines has essentially been finished. A cross-section through the opening cylinders 10 produced by the method according to the present invention is shown in FIGS. 2.1 to 6.1, FIGS. 2.2, 3.2, 4.2, 5.2 and 6.2 showing each a detailed view of the cross-section of the opening cylinders 10 shown in FIGS. 2.1, 2.2, 3.1, 4.1, 5.1 and 6.1.

The basic wire 3 and the sawtooth wire 4 are normally wound onto the expansion arbor 1 in a width corresponding approximaterly to the width of an opening cylinder 10. It is, however, also possible to provide an arbitrary number of spirals 7 and 8 so that the finished workpiece is divided several times for obtaining a plurality of opening cylinders.

After the welding, the opening cylinder is normally straightened so as to equalize the thermal stress which resulted from the welding operation. Subsequently, the final shape of the opening cylinder and of the sawtooth wire can be produced by turning and grinding.

In order to simplify machining of the opening cylinder, the basic wire 3 consists of low-carbon steel. In order to permit a heat treatment of the sawtooth wire, said sawtooth wire consists of high-carbon steel.

The embodiment shown in FIG. 1, shows the simplest embodiment of the present invention. This embodiment is additionally shown in FIGS. 6.1 and 6.2. The basic wire 3 has an essentially square cross-section with lateral surfaces 11 and a lower surface 12, which defines the inner surface of the opening cylinder, and an upper surface 13, which defines the top surface of the opening cylinder.

The lateral surfaces 11 of the basic wire 3 abut on one another due to the fact that the basic wire 3 is spirally wound. The body 14 of the opening cylinder 10 is defined by the spirally wound basic wire 3. The sawtooth wire 4 comprises a toothed section 15 and a base section 16 with a base surface 17. The sawtooth wire 4, which is also spirally wound, rests on the upper surface 13 of the body 14 via this base surface 17. The base surface 17 extends between two neighbouring upper surfaces 13. The base section 16 additionally comprises flank portions 18 which abut on one another due to the fact that the sawtooth wire 4 is spirally wound. Due to the welding, the neighbouring flank portions 18 of two base sections 16 are welded together. The welding is dimensioned such that a so-called through-welding is carried out, which welds together the two base sections 16 of the sawtooth wire 4 as well as the upper surface 13 of the basic wire arranged between two neighbouring flank portions 18. This can clearly be seen in FIG. 6.2, where the welding is designated by reference symbol "S". Hence, the spirals of the basic wire are not directly interconnected by welding, but only indirectly via the base section of the sawtooth wire. Each base section has associated therewith two neighbouring spirals of the basic wire. Hence, one operation suffices to form the body 14 and to weld the sawtooth wire to said body at the same time.

The basic wire 3 can have different cross-sections. These cross-sections are shown in FIGS. 2.2, 3.2, 4.2 and 5.2. The basic wire 3 can, for example, be provided with a recess 19 which extends in the longitudinal direction thereof and which forms a groove 20 when the basic wire 3 is wound onto the expansion arbor, the base section 16 of the sawtooth wire 4 being accommodated in said groove 20. It is also possible to provide two recesses 19 on both lateral surfaces 11. The shape of the resultant grooves can clearly be seen in the figures. In addition, the lateral surfaces 11 may also be provided with projections 21 which are received in recesses 19 of the respective opposed lateral surface 11 so as to permit a positive engagement of the individual spirals of the basic wire 3. This is a possibility of increasing the strength of the body 14 defined by the basic wire still further.

In the following, the mode of operation of the present invention will be explained in detail: for producing an opening cylinder 10, the expansion arbor 1 is first caused to rotate abouts its axis of rotation 2. Following this, the basic wire 3 and the sawtooth wire 4 are supplied to the expansion arbor 1 by a feed means, which is not shown, and are wound around said expansion arbor 1 such that at least one winding or one spiral 7, 8 is formed. As soon as one spiral 7, 8 has been wound onto the expansion arbor 1, additional basic wire 3 and sawtooth wire 4 can be supplied continuously; while said wires are being supplied, the flank portions 18 of two neighbouring spirals of the sawtooth wire are welded together and said welding produces at the same time also a welded joint of the two neighbouring flank portions 18 and of the upper surface 13 of the associated basic wire. Hence, only one welding operation will suffice to produce a spiral winding of the basic wire 3 and of the sawtooth wire 4 at the same time, said basic wire and sawtooth wire defining the opening cylinder 10. The body 14 is formed by the basic wire 3.

The pressure roller 5 produces a force parallel to the axis of rotation 2 of the expansion arbor 1 towards the already finished spirals 7, 8 so as to guarantee that the basic wire 3 and the sawtooth wire 4 are wound closely and uniformly.

When the desired number of windings or a predetermined width of the opening cylinder 10 has been obtained, the supply of basic wire 3 and sawtooth wire 4 is finished and the sawtooth wire 4 and the basic wire 3 are cut off.

The opening cylinder 10 can now be removed from the expansion arbor 1 and straightened so as to equalize the thermal stress which resulted from the welding operation. Subsequently, the opening cylinder 10 is subjected to a turning treatment so as to obtain the desired final dimensions.

Alternatively, the opening cylinder 10 can also be produced by using a prefabricated body 14 instead of the expansion arbor 1. In analogy with the above-described method, the sawtooth wire 4 can then be applied to this body 14, said sawtooth wire 4 being welded onto said body 14 while it is being applied thereto. In order to improve the strength, also the flank portions 18 can be welded together. Alternatively, the sawtooth wire can also be welded onto the body by welding together only the windings of said sawtooth wire, the welding operation being carried out such that through-welding through the sawtooth wire and down to the body takes place. It is thus possible to weld together in one operation the windings of the sawtooth wire as well as the body and the sawtooth wire.

By means of this new method, an opening cylinder can be produced continuously and economically in one operation.

What is claimed is:

1. A method of producing an opening cylinder for an open-end spinning machine, comprising the step of applying to a surface of a body of the opening cylinder a spirally extending sawtooth wire, wherein the sawtooth wire is supplied continuously to the body, and is welded to said body and wherein the welding is carried out immediately when the sawtooth wire is supplied.

2. A method according to claim 1, the sawtooth wire is supplied to the rotating body.

3. A method according to claim 1, wherein the body is formed by winding a basic wire onto a rotating expansion arbor.

4. A method according to claim 3, wherein spirals which are formed by winding on the basic wire and which abut on one another are welded together during the winding operation.

5. A method according to claim 3, wherein the basic wire and the sawtooth wire are supplied simultaneously.

6. A method according to claim 4, wherein the spirals formed by winding on the sawtooth wire are welded to the basic wire.

7. A method according to claim 1, spirals formed by winding on the sawtooth wire abut on one another and are welded together.

8. A method according to claim 1, wherein the welding is carried out continuously.

9. A method according to claim 3, wherein the welding is carried out in the form of a discontinuous welding process.

10. A method according to claim 3, wherein at least one pressure roller is provided by means of which at least one of the supplied sawtooth wire and the basic wire is pressed against the body which has already been formed and against the sawtooth wire which has already been applied.

11. A method according to claim 3, wherein the axis of rotation of the pressure roller extends at right angles to the axis of rotation of the body and of the expansion arbor, respectively.

12. A method according to claim 3, wherein the basic wire forms a body having an essentially smooth surface onto which the sawtooth wire is applied.

13. A method according to claim 3, wherein the body is formed by the basic wire and is provided with spiral grooves which accommodate a base section of the sawtooth wire.

14. A method according to claim 1, wherein the finished body with the sawtooth wire is given its final shape by turning.

15. A method according to claim 1, wherein the body having the sawtooth wire welded thereon is straightened.

16. A method according to claim 1, wherein the welding method used is a precision welding method.

17. A method according to claim 3, wherein the basic wire consists of low-carbon steel.

18. A method according to claim 1, wherein the sawtooth wire consists of high-carbon steel.

19. A method according to claim 1, wherein the sawtooth wire consists of alloy steel.

20. A method according to claim 1, wherein the length of the cylinder body produced corresponds to a length of one finished opening cylinder.

21. A method according to claim 9 wherein the welding is carried out in the form of a high-frequency pulsed current arc welding process.

22. A method according to claim 9 wherein the welding is carried out in the form of a spot welding process.

23. A method according to claim 16 Wherein the welding method used is a laser-beam welding.

24. A method according to claim 16 wherein the welding method used is an electron-beam welding method.

25. A method according to claim 19 wherein the sawtooth wire consists of a microalloy steel.

26. A method according to claim 1 wherein the length of the cylinder body produced corresponds to a plurality of finished opening cylinders.

27. An opening cylinder comprising a body on a surface of which a spirally extending sawtooth wire is arranged, and the sawtooth wire is welded to said body, wherein the body is formed by at least one spirally wound basic wire.

28. An opening cylinder according to claim 27, wherein in a longitudinal direction of the body, the sawtooth wire borders on two neighboring spirals of the body defined by the basic wire.

29. An opening cylinder according to claim 27, wherein spirals of the body are indirectly connected to one another due to the fact that they are welded to spirals of the sawtooth wire.

30. An opening cylinder according to claim 27, wherein neighboring spirals of the sawtooth wire are welded together.

31. An opening cylinder according to claim 27, wherein two neighboring spirals of the sawtooth wire are connected to one another as well as to the body by through-welding.

* * * * *